US006612520B2

(12) United States Patent
Gutierrez et al.

(10) Patent No.: US 6,612,520 B2
(45) Date of Patent: Sep. 2, 2003

(54) SOLENOID COIL ASSEMBLY AND METHOD FOR WINDING COILS

(75) Inventors: Roberto Gutierrez, El Paso, TX (US); Samuel S Newcomer, El Paso, TX (US); Alvaro J Carrillo, Chihuahua (MX); German Alvizouri, Chihuahua (MX)

(73) Assignee: Delphi Technologies, Inc., Troy, MI (US)

( * ) Notice: Subject to any disclaimer, the term of this patent is extended or adjusted under 35 U.S.C. 154(b) by 129 days.

(21) Appl. No.: 09/929,581

(22) Filed: Aug. 14, 2001

(65) Prior Publication Data

US 2003/0034418 A1 Feb. 20, 2003

(51) Int. Cl.[7] ..... B65H 81/06

(52) U.S. Cl. ..... 242/443; 29/605

(58) Field of Search ..... 242/443, 448; 29/605

(56) References Cited

U.S. PATENT DOCUMENTS

| | | | | |
|---|---|---|---|---|
| 4,558,200 A | * | 12/1985 | Weigand, Jr. | 219/85.15 |
| 5,524,334 A | * | 6/1996 | Boesel | 29/605 |
| 5,535,083 A | * | 7/1996 | Sako et al. | 361/38 |
| 6,369,682 B1 | * | 4/2002 | Thompson et al. | 336/192 |

* cited by examiner

*Primary Examiner*—Emmanuel Marcelo
(74) *Attorney, Agent, or Firm*—Margaret A. Dobrowitsky

(57) ABSTRACT

A coil assembly includes a spool and a connector keyed thereto. To wind a coil on the spool, the spool is moved linearly with respect to the connector until the connector does not interfere with the winding bay on the spool. Thereafter, a wire is wound around the spool within the winding bay to form the coil. Once the coil is complete, the spool can be moved linearly with respect to the connector until a keying structure on the spool engages an opposing keying structure on the connector and a locking mechanism on the spool engages a corresponding locking mechanism on the connector. Thus, a complete coil assembly can be manufactured in one operation with minimal manufacturing steps.

28 Claims, 2 Drawing Sheets

Fig. 5
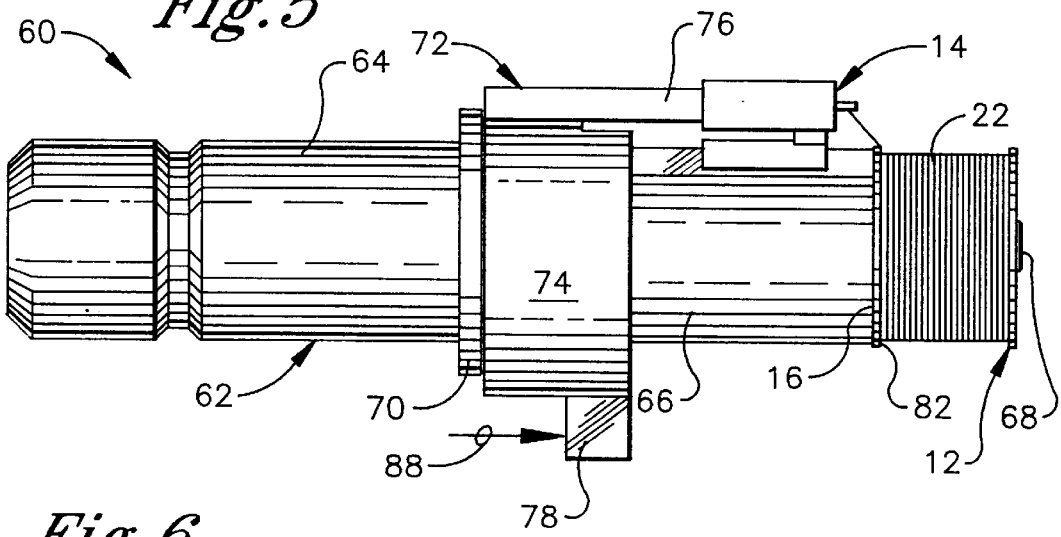
Fig. 6
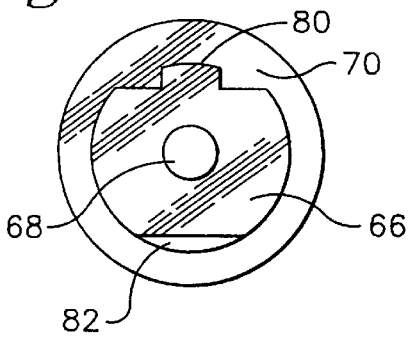
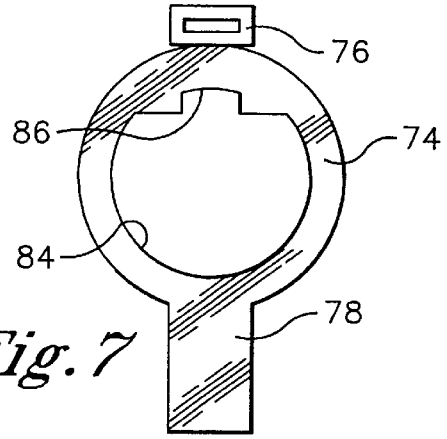
Fig. 7
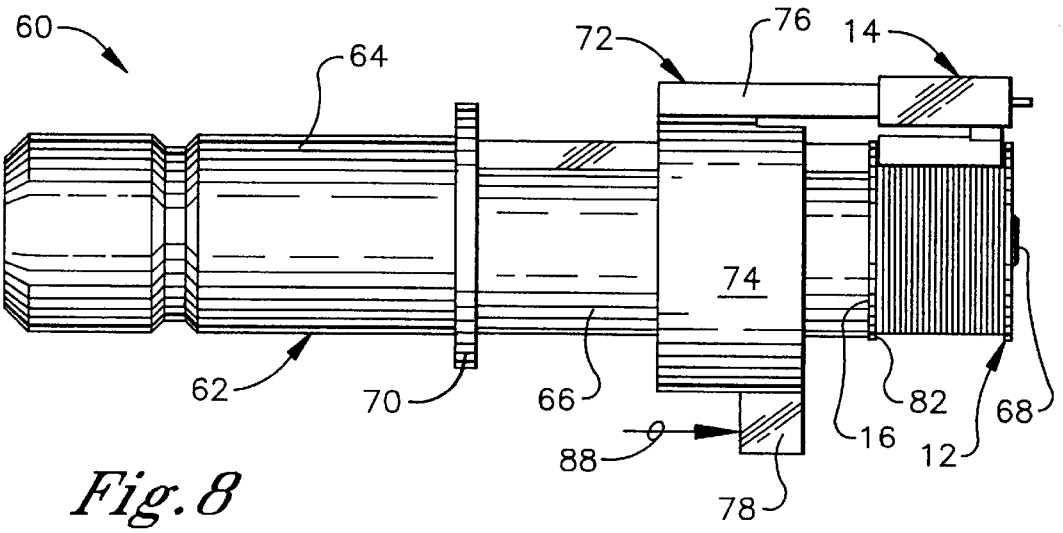
Fig. 8

SOLENOID COIL ASSEMBLY AND METHOD FOR WINDING COILS

TECHNICAL FIELD

The present invention relates to solenoids and actuators.

BACKGROUND OF THE INVENTION

Modem motor vehicles are equipped with numerous vehicle subsystems that are designed to increase the comfort and safety of drivers and passengers. For example, a vehicle can include an anti-lock braking system, a traction control system, a speed control system, and/or a vehicle stability enhancement control system. In turn, each subsystem can include numerous electromagnetic sensors and/or actuators that utilize electric coils to move plungers when energized or to provide control signals in response to changes in magnetic flux around the sensing coils.

In general, these coils include a plastic "I" shaped spool that include a winding surface or "bay" with a thin wire wound there around to form the coil. The ends of the wire are connected to terminals that can be electrically connected to a control system to allow the coil to be energized or to send a signal to the control system. A plunger or a sensing structure can be disposed within the spool, i.e., within the coil.

Manufacturing this type of coil is often complicated by the need to attach the coil to an electric connector. If the completed coil assembly is designed so that the connector does not interfere with the winding bay on the spool, it is relatively easy to wind the coil and terminate the wire at the connector in one operation. Unfortunately, in most cases, the completed coil assembly is such that the connector interferes with the winding bay during winding. To avoid interference, the coil is wound first and then a series of interim steps is performed in order to complete the assembly with a connector. For example, the coil can be wound around a molded spool and then connected to a connector that is molded in a separate process. Or, the coil can be wound around a molded spool and then a connector can be overmolded around the completed coil assembly. In either situation, the extra process steps increase the manufacturing costs.

The present invention has recognized these prior art drawbacks, and has provided the below-disclosed solutions to one or more of the prior art deficiencies.

SUMMARY OF THE INVENTION

A solenoid coil assembly includes a connector, a spool, and a keying mechanism. The keying mechanism allows the spool to be assembled to the connector in one and only one configuration. Accordingly, the keying mechanism includes a post that extends from the connector and an eyelet that extends from the spool. The eyelet is sized and shaped to fit over the post.

Preferably, the keying mechanism also includes a tongue that extends from the spool and fits into a correspondingly sized and shaped opening that is formed by the connector. In a preferred embodiment, the spool includes a first end cap and a second end cap and the eyelet extends radially from the first end cap. Moreover, the connector further includes a wall that has an end plate which forms the opening into which the tongue fits. Preferably, the tongue extends radially from the second end cap. In a preferred embodiment, the wall is curved and has a radius of curvature that matches the outer periphery of the end caps. Also, the coil assembly includes a wire wound around the spool to form a coil.

In another aspect of the present invention, a method for winding a coil on a spool includes providing a spool that has a winding bay. The spool is keyed to a connector that has at least two terminals. The spool is moved linearly with respect to the connector so that the connector does not interfere with the winding bay. A wire is connected to one of the terminals. Then, the wire is wound around the spool to form a coil.

In yet another aspect of the present invention, a coil assembly includes a connector, a spool, and keying mechanism that keys the connector to the spool.

In still another aspect of the present invention, a coil assembly includes a connector means, a spool means, and a means for keying the connector to the spool.

In yet still another aspect of the present invention, a device for moving a connector with respect to a spool that defines a winding area includes an arbor that supports the spool and a connector shuttle that supports the connector. The connector shuttle is slidably disposed on the arbor and the connector shuttle is movable between a winding position, wherein the connector does not interfere with the winding area, and an assembled position, wherein the connector engages the coil.

In another aspect of the present invention, a method for winding a coil on a spool includes providing an arbor and providing a connector shuttle that is slidably disposed on the arbor. A spool that has a winding bay is installed on the arbor. The spool is keyed to a connector having at least two terminals. A connector is installed on the connector shuttle. Thereafter, the connector shuttle is moved linearly with respect to the arbor so the connector does not interfere with the winding bay. A wire is connected a wire to one of the terminals and then, the wire is wound around the spool to form a coil.

The present invention will now be described, by way of example, with reference to the accompanying drawings, in which:

BRIEF DESCRIPTION OF THE DRAWINGS

FIG. 5 is a side plan view of a shuttling assembly in the winding position;

FIG. 6 is an end view of the arbor;

FIG. 7 is an end view of the shuttle; and

FIG. 8 is a side plan view of a shuttling assembly in the assembled position.

DESCRIPTION OF AN EMBODIMENT OF THE INVENTION

Figure 1:
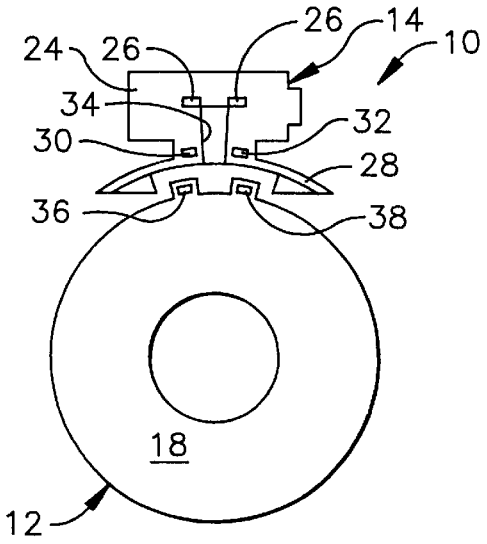
FIG. 1 is an exploded top plan view of the coil assembly.
Figure 2:
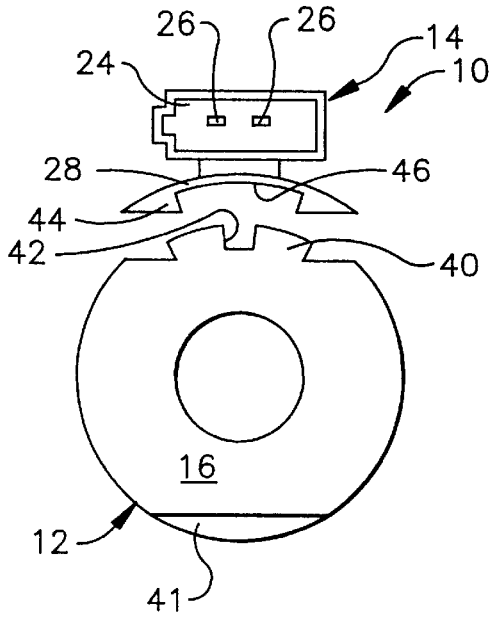
FIG. 2 is an exploded bottom plan view of the coil assembly.
Figure 3:
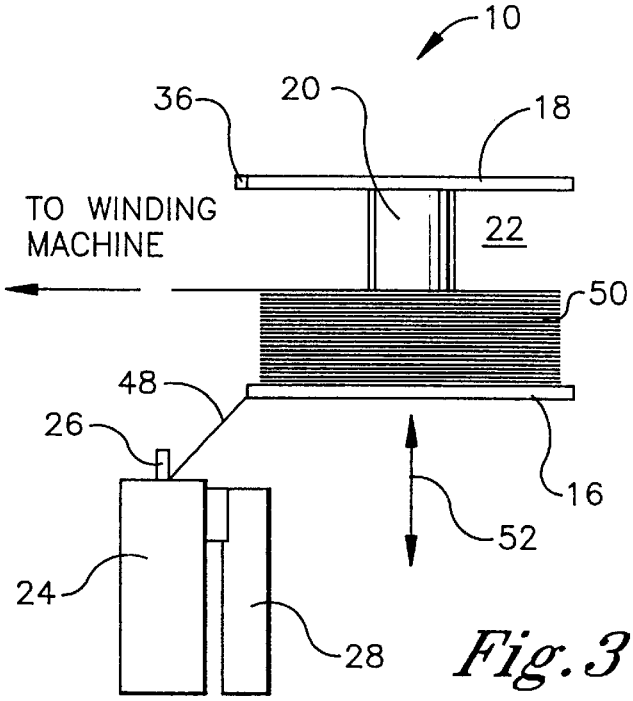
FIG. 3 is a side plan view of the coil assembly with the spool moved linearly away from the connector.

Referring to FIGS. 1–3, a coil assembly is shown and generally designated 10. FIGS. 1–3 show that the coil assembly 10 includes a generally "I" shaped spool 12 and a connector 14. FIGS. 1–3 show that the spool 12 includes a generally disk-shaped first end cap 16, a generally disk-shaped second end cap 18, and a hollow, generally cylindrical shaft 20 therebetween. A coil winding bay 22 is formed around the shaft 20 between the end caps 16, 18.

As shown in FIGS. 1–3, the connector 14 includes a female housing 24 in which a correspondingly sized and shaped male connector (not shown) is inserted. The male connector can be connected to a control system wire harness. A pair of terminals 26 are placed within the housing 24 and at least partially extend therefrom. FIGS. 1–3 show that the connector 14 also includes a curved wall 28 that has a radius of curvature that matches the outer periphery of the end caps 16, 18.

Referring to FIG. 1, a relatively small, solid first post 30 and a relatively small, solid second post 32 extend perpendicularly from the top of the connector 14. Moreover, a channel 34 leading to the terminals 26 is formed in the top of the connector 14 between the posts 30, 32. As set forth further below, the channel 34 facilitates the connection of the coil wire, described below, to the terminals 24. FIG. 1 also shows that the second end cap 18 includes a first eyelet 36 and a second eyelet 38 extending from the outer periphery of the second end cap 18. According to the present invention, the first eyelet 36 and second eyelet 38 are configured to fit tightly over the first post 30 and second post 32, respectively.

As shown in FIG. 2, the outer periphery of the first end cap 16 forms a tongue 40 and a flat portion 41 opposite the tongue. The tongue 40 is formed with a slot 42 that facilitates connection of a coil wire, described below, to the terminals 26. As described in detail below, the flat portion 41 of the outer periphery of the first end cap 16 keeps the spool 12 from rotating during the winding process. FIG. 2 also shows that the curved wall 28 includes an end plate 44 that is formed with an opening 46 designed to receive the tongue 40 formed by the first end cap 16.

Referring now to FIG. 3, the coil assembly 10 is shown with the spool 12 positioned parallel to the connector 14, but above the connector 14 so that the connector 14 does not interfere with the winding bay 22. As shown in FIG. 3, a relatively thin wire 48 is connected to one of the terminals 26 and then wound around the spool 12, within the winding bay 22, numerous times in order to form a coil 50. After the coil 50 is completely formed, the connector 14 is moved with respect to the spool 12, as indicated by arrow 52, until the eyelets 36, 38 engage the posts 30, 32 and the tongue 40 engages the opening 46 formed in the end plate 44 of the curved wall 28. Preferably, the spool 12 remains stationary and the connector 14 is moved, but it can be appreciated that the connector 14 can be held stationary and the spool 12 moved. Thereafter, the coil wire 56 is connected to the remaining terminal 26 and a cap 54 is placed over the terminals 26, as shown in FIG. 4.

Figure 4:
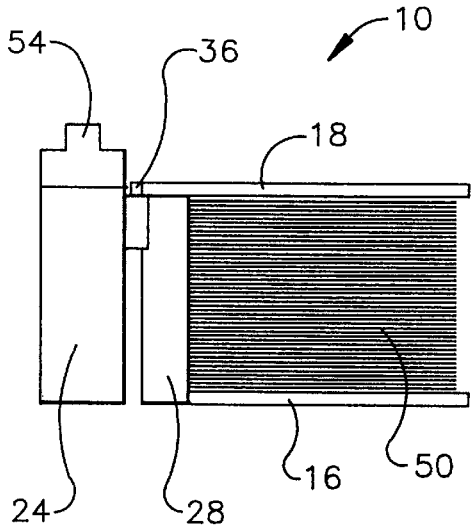
FIG. 4 is a side plan view of the complete coil assembly.

FIG. 5 shows one exemplary shuttling assembly, generally designated 60, that can be used to move the connector 14 with respect to the spool 12, after the coil 58 is wound, so that the keying mechanism on the connector 14 engages the corresponding keying mechanism on the spool 12 to form the coil assembly 10 shown in FIG. 4. FIG. 5 shows that the shuttling assembly 60 includes a solid generally cylindrical winding arbor 62 having a winding machine shaft portion 64 that is sized and shaped to be inserted into a winding machine (not shown), e.g, into the winding machine chuck. The arbor 62 further includes a shuttle support shaft portion 66 and spool support shaft portion 68. A stop 70 extends radially from the arbor and separates the winding machine shaft portion 62 from the shuttle support shaft portion 66.

As shown in FIG. 5, a connector shuttle 72 is slidably disposed on the shuttle support shaft portion 66 of the arbor 62. FIG. 5 shows that the connector shuttle 72 includes a collar 74 that fits around the shuttle support shaft portion 66. A male connector support 76 extends tangentially from the collar 74 such that it is parallel to arbor 62. The male connector support 76 is sized and shaped to engage the female housing 24 formed by the connector 14. As shown, a counter balance 78 extends from the collar 74 opposite the male connector support 76. It is to be appreciated that the counter balance 78 balances the shuttle 72 to keep it from binding on the arbor 62 as it is moved along the length of the shuttle support shaft portion 66. The counter balance 78 also balances the shuttle 72 when the arbor 64 is rotated in order to wind the coil 50 onto the spool 12.

Referring to FIG. 6, the shuttle support shaft portion 66 is machined, or otherwise formed, with a tongue 80 along the entire length of the shuttle support shaft portion 66. Moreover, the end of the shuttle support shaft portion 66 includes a lip 82. As described in detail below, the lip 82 engages the flat portion 41 of the outer periphery of the first end cap 16 when the spool 12 is placed on the spool support shaft portion 68 of the arbor 62 for winding. FIG. 7 shows that the collar 74 includes an internal bore 84 formed with a groove 86 that is sized and shaped to receive the tongue 80 formed along the length of the shuttle support shaft portion 66. The groove 86 engages the tongue 80 to keep the connector shuttle 72 from rotating with respect to the arbor 62 as it slides thereon.

As shown in FIGS. 5 and 8, the male connector support 76 is inserted into the female housing 24 formed by the connector 14. Moreover, the spool 12 is inserted over the spool support shaft portion 68. As shown, the spool 12 is oriented so that the flat portion 41 formed in the outer periphery of the first end cap 16 engages the lip 82 that extends from the end of the shuttle support shaft portion 66. During winding, the connector shuttle 72 is moved to the left, looking at FIGS. 5 and 8, along the shuttle support shaft portion 66 of the arbor 62 until it is immediately adjacent to the stop 70 and the connector shuttle 72 is in the winding position, as shown in FIG. 5. The connector 14 moves with the connector shuttle 72, and in the winding position, the connector 14 does not block the winding bay 22 established around the spool 12.

After the coil 50 is completely wound, the connector shuttle 72 is moved along the shuttle support shaft portion 66, to the right looking at FIGS. 5 and 8, until the connector shuttle 72 is in the assembled position, as shown in FIG. 8. It is to be understood that a force, represented by arrow 88, is be applied to the shuttle 72, e.g., on the counter balance 78, in order to move in into the assembled position. The force can be applied to the shuttle 72 in a number of ways. For example, the winding machine (not shown) in which the arbor 64 is inserted can include a bar or arm that is actuated by a servo motor in order to engage the shuttle 72 and move it as described above. On the other hand, the winding machine can include one or more hydraulic or pneumatic pistons that move the shuttle 72, directly or through a bar or arm, into the assembled positioned after the coil 50 is wound. It is to be appreciated that a typical winding machine includes numerous rotational and servo motors and pneumatic actuators that are incorporated into the machine in order to provide other functions, e.g., cutting the wire 48 after the coil 50 is wound. Thus, it could be quite easy to adapt an existing winding machine so that it will automatically assemble the coil assembly 10 after the coil 50 is wound.

It is to be understood that in the assembled position, the connector 14 completely engages the spool 12, i.e., the keying mechanism formed by the connector 14 engages the opposing keying mechanism formed by the spool 12, to form the completed coil assembly 10, shown in FIG. 4. After the coil assembly 110 is fully assembled, the connector shuttle 72 can be moved to the left, looking at FIGS. 5 and 8, until the male connector support 76 disengages the female housing 24 formed by the connector 14.

With the configuration of structure described above, it is to be appreciated that the spool 12 is keyed to the connector 14 by the cooperation of the tongue 40 and the opening 46 in the end plate 44 and by the cooperation of the posts 30, 32 and the eyelets 36, 38. It is also to be appreciated that the keying structure described above, or similar means, can be used to key a spool and connector of nearly any geometry to each other. With the structure described above, the wire 48 can be wound around the spool 12 to form the coil 50 and the connector 14 can be relatively easily moved into to position wherein it engages the spool 12 to complete the assembly of the coil assembly 10. Thus, a complete coil assembly 10 can be manufactured in one operation with minimal steps thereby reducing the costs associated with manufacturing the coil assembly 10.

While the particular SOLENOID COIL ASSEMBLY AND METHOD FOR WINDING COILS as herein shown and described in detail is fully capable of attaining the above-described objects of the invention, it is to be understood that it is the presently preferred embodiment of the present invention and thus, is representative of the subject matter which is broadly contemplated by the present invention, that the scope of the present invention fully encompasses other embodiments which may become obvious to those skilled in the art, and that the invention is accordingly to be limited by nothing other than the appended claims, in which reference to an element in the singular is not intended to mean "one and only one" unless explicitly so stated, but rather "one or more." All structural and functional equivalents to the elements of the above-described preferred embodiment that are known or later come to be known to those of ordinary skill in the art are expressly incorporated herein by reference and are intended to be encompassed by the present claims. Moreover, it is not necessary for a device or method to address each and every problem sought to be solved by the present invention, for it is to be encompassed by the present claims. Furthermore, no element, component, or method step in the present disclosure is intended to be dedicated to the public regardless of whether the element, component, or method step is explicitly recited in the claims. No claim element herein is to be construed under the provisions of 35 U.S.C. section 112, sixth paragraph, unless the element is expressly recited using the phrase "means for."

We claim:

1. A coil assembly, comprising:

a connector a spool; and a keying mechanism allowing the spool to be assembled to the connector in one and only one configuration, the keying mechanism comprising at least one post extending from the connector and at least one eyelet extending from the spool, the eyelet being sized and shaped to fit over the post, wherein the keying mechanism further comprises at least one tongue extending from the spool and at least one opening formed by the connector, the opening being sized and shaped to receive the tongue.

2. The coil assembly of claim 1, wherein the spool includes a first end cap and a second end cap, the first end cap having the at least one eyelet extending radially therefrom.

3. The coil assembly of claim 2, wherein the connector further comprises a wall having an end plate, the end plate forming the opening into which the tongue fits.

4. The coil assembly of claim 3, wherein the tongue extends radially from the second end cap.

5. The coil assembly of claim 3, wherein the wall is curved.

6. The coil assembly of claim 5, wherein the wall has a radius of curvature that matches the outer periphery of the end caps.

7. The coil assembly of claim 3, further comprising a wire wound around the spool to form a coil.

8. A method for winding a coil on a spool comprising the acts of:

providing a spool having a winding bay, the spool being keyed to a connector having at least two terminals;

moving the connector linearly with respect to the spool so the connector does not interfere with the winding bay;

connecting a wire to at least one terminal; and winding the wire around the spool to form a coil.

9. The method of claim 8, further comprising the act of:

moving the connector linearly with respect to the spool until a keyed structure on the spool engages an opposing keyed structure on the connector and a locking mechanism on the spool engages a corresponding locking mechanism on the connector.

10. The method of claim 9, further comprising the act of:

connecting the wire to at least one other terminal.

11. The method of claim 8, further comprising the act of:

installing a cap over the terminals.

12. A coil assembly, comprising:

a connector;

a spool; and a keying mechanism keying the connector to the spool wherein:

at least one wall of the connector is curved.

13. The coil assembly of claim 12, wherein the keying mechanism comprises at least one post extending from the connector and at least one eyelet extending from the spool, the eyelet being sized and shaped to fit over the post.

14. The coil assembly of claim 13, wherein the keying mechanism further comprises at least one tongue extending from the spool and at least one opening formed by the connector, the opening being sized and shaped to receive the tongue.

15. The coil assembly of claim 14, wherein the spool includes a first end cap and a second end cap, the first end cap having the at least one eyelet extending radially therefrom.

16. The coil assembly of claim 15, wherein the connector further comprises a wall having an end plate, the end plate forming the opening into which the tongue fits.

17. The coil assembly of claim 16, wherein the tongue extends radially from the second end cap.

18. The coil assembly of claim 12, wherein the wall has a radius of curvature that matches the outer periphery of the end caps.

19. The coil assembly of claim 18, further comprising a wire wound around the spool to form a coil.

20. A device for moving a connector with respect to a spool defining a winding area, the device comprising:

at least one arbor supporting the spool;

at least one connector shuttle supporting the connector, the connector shuttle being slidably disposed on the arbor, the connector shuttle being movable between a winding position, wherein the connector does not interfere with the winding area, and an assembled position, wherein the connector engages the coil.

21. The device of claim 20, wherein the connector shuttle is keyed to the arbor such that the connector shuttle can not rotate with respect to the arbor.

22. The device of claim 20, wherein the arbor includes a shuttle support shaft portion along which the connector shuttle slides and a spool support shaft portion on which the spool can be placed for winding.

23. The device of claim 20, wherein the arbor includes a winding machine shaft portion that is configured to be engaged by a winding machine.

24. The device of claim 20, wherein the connector includes a female housing and the connector shuttle includes a male connector support that is sized and shaped to engage the female housing.

25. A method for winding a coil on a spool comprising the acts of:

providing an arbor;

providing a connector shuttle slidably disposed on the arbor;

installing a spool on the arbor the spool having a winding bay, the spool being keyed to a connector having at least two terminals;

installing a connector on the connector shuttle;

moving the connector shuttle linearly with respect to the arbor so the connector does not interfere with the winding bay;

connecting a wire to at least one terminal; and winding the wire around the spool to form a coil.

26. The method of claim 25, further comprising the act of:

moving the connector shuttle with respect to the arbor until a keyed structure on the spool engages an opposing keyed structure on the connector and a locking mechanism on the spool engages a corresponding locking mechanism on the connector.

27. The method of claim 26, further comprising the act of:

connecting the wire to at least one other terminal.

28. The method of claim 27, further comprising the act of:

installing a cap over the terminals.

* * * * *